United States Patent [19]

Wake

[11] Patent Number: 4,951,485

[45] Date of Patent: Aug. 28, 1990

[54] DIAL LOCK DEVICE FOR SLIDE FASTENERS

[75] Inventor: Kiyoyasu Wake, Kawasaki, Japan

[73] Assignee: Yoshida Kogyo K. K., Tokyo, Japan

[21] Appl. No.: 426,724

[22] Filed: Oct. 26, 1989

[30] Foreign Application Priority Data

May 20, 1988 [JP] Japan ..... 63-66718
May 27, 1988 [JP] Japan ..... 63-70145

[51] Int. Cl.[5] ..... E05B 67/38
[52] U.S. Cl. ..... 70/68; 24/388
[58] Field of Search ..... 70/68; 24/388, 389

[56] References Cited

U.S. PATENT DOCUMENTS

| | | | |
|---|---|---|---|
| 2,233,661 | 3/1941 | Bugg | 70/68 |
| 2,741,114 | 4/1956 | Poux | 70/68 |
| 3,270,535 | 9/1966 | Fukuroi | 70/68 |
| 4,015,457 | 4/1977 | Fukuroi | 70/68 |
| 4,221,027 | 9/1980 | Oda | 70/68 X |
| 4,262,502 | 4/1981 | Oda | 70/68 |
| 4,271,689 | 6/1981 | Kasai | 70/68 |

FOREIGN PATENT DOCUMENTS

| | | | |
|---|---|---|---|
| 63-110211 | 7/1988 | Japan . | |
| 1036410 | 7/1966 | United Kingdom | 70/68 |

*Primary Examiner*—Lloyd A. Gall
*Attorney, Agent, or Firm*—Hill, Van Santen, Steadman & Simpson

[57] ABSTRACT

A lock device for use on slide fasteners to open and close the same is disclosed which is essentially constructed with a slider body comprising upper and lower wings, a lock prong disposed movably on the upper wing and between a position to engage with the coupling elements of the slide fastener and a dial lock mechanism mounted fixedly or movably on the upper wing to thereby allow the lock prong to move in the locked and unlocked positions. The lock mechanism is built of specified component parts.

11 Claims, 11 Drawing Sheets

DIAL LOCK DEVICE FOR SLIDE FASTENERS

BACKGROUND OF THE INVENTION

1. Technical Field

This invention relates to a locking device and more particularly to a dial lock assembly suitable for use on slide fasteners.

2. Prior Art

Many dial lock devices are known, a typical example of which is disclosed for instance in Japanese Utility Model Laid-Open Publication No. 63-110211. The disclosed lock device comprises a pair of sliders assembled with a slide fastener for opening and closing the same from both ends. One such slider includes a latch holder, a latch plate normally biased by spring means in a position to hold the slider in abutted relation to the other slider and a dial rotatably mounted on the latch holder to respectively block and allow the movement of the latch plate, thereby keeping locked and unlocked the two sliders.

The above prior lock device is not wholly satisfactory in respect of the efficiency of locking operation as it is necessary to position the two sliders into registry with each other. This type of lock arrangement is also disadvantageous in that the sliders when in unlocking position are unsightly dangling in an unsightly manner from the slide fastener on two opposite ends. This is particularly the case on attachment to a closure article such as bag, luggage or clothing, in that the latch plate is liable by accident to become disengaged from the latch holder and in that the use of two sliders is costly.

SUMMARY OF THE INVENTION

With the foregoing difficulties of the prior art in view, the present invention seeks to provide an improved dial combination lock assembly for use on slide fasteners which is aesthetic in appearance, simple in construction and reliable in operation.

The above and other objects and features of the invention will become better understood from the following description taken in conjunction with the accompanying drawings. Like reference numerals refer to like or corresponding parts throughout the several views.

DETAILED DESCRIPTION OF THE INVENTION

Figure 1:
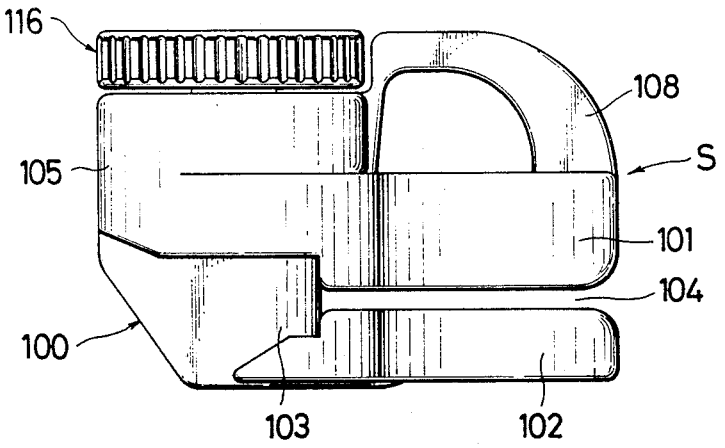
FIG. 1 is a side elevational view, partly sectional, of a combination lock assembly embodying a first preferred embodiment of the present invention.
Figure 2:
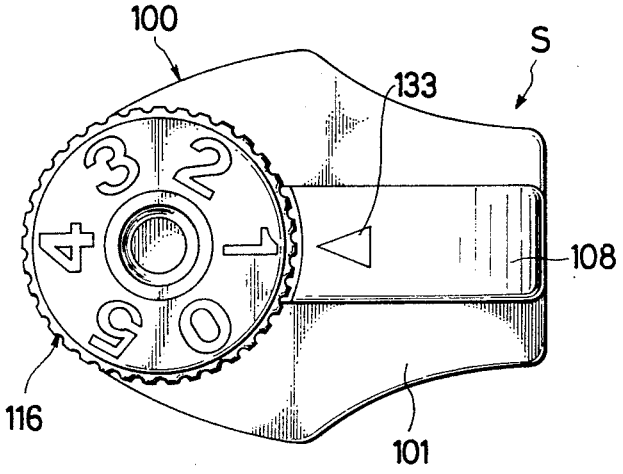
FIG. 2 is a top plan view of the lock assembly of FIG. 1.

Referring now to the drawings and FIGS. 1 to 11 in particular, there is shown a dial lock assembly 100 embodying a first preferred embodiment of the present invention and adapted to be used on a slide fastener F to open and close the same. The slide fastener F comprises, as viewed in FIG. 9, a pair of stringer tapes T, T carrying along one of their longitudinal edges a row of coupling elements E to be meshed and unmeshed by a slider in known manner.

Figure 3:
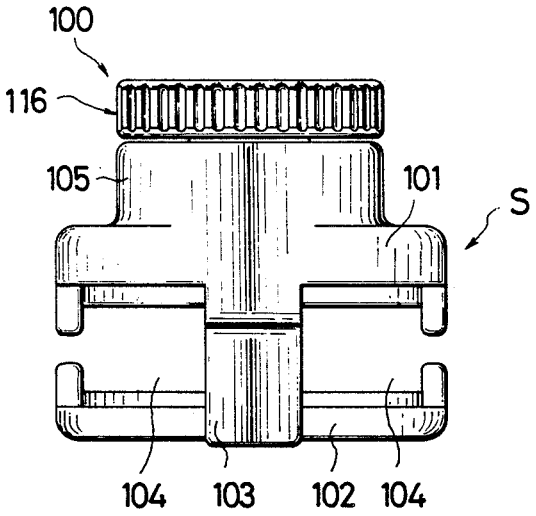
FIGS. 3 and 4 are front and rear elevational views, respectively, of the lock assembly of FIG. 1.
Figure 4:
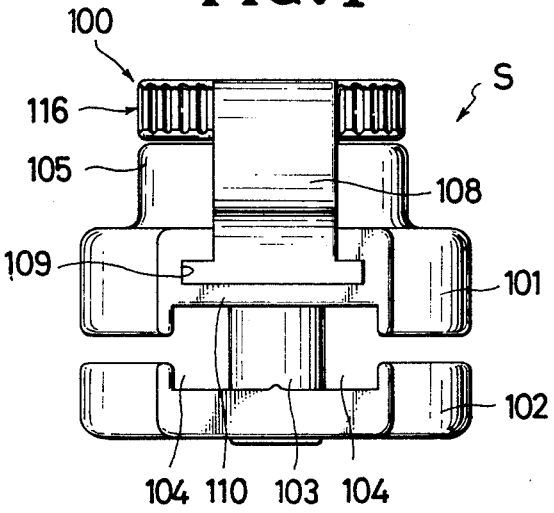
Figure 5:
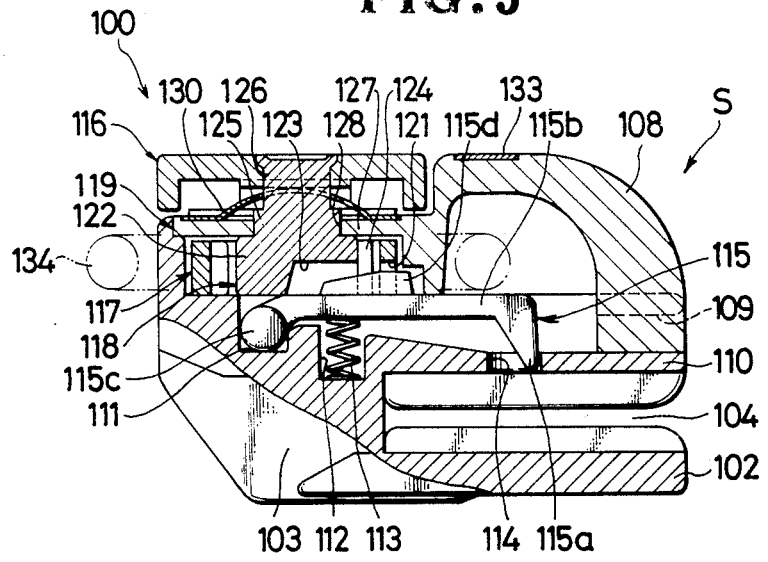
FIG. 5 is a partly broken cross-sectional view of the lock assembly of FIG. 1 showing the same in unlocked position.
Figure 6:
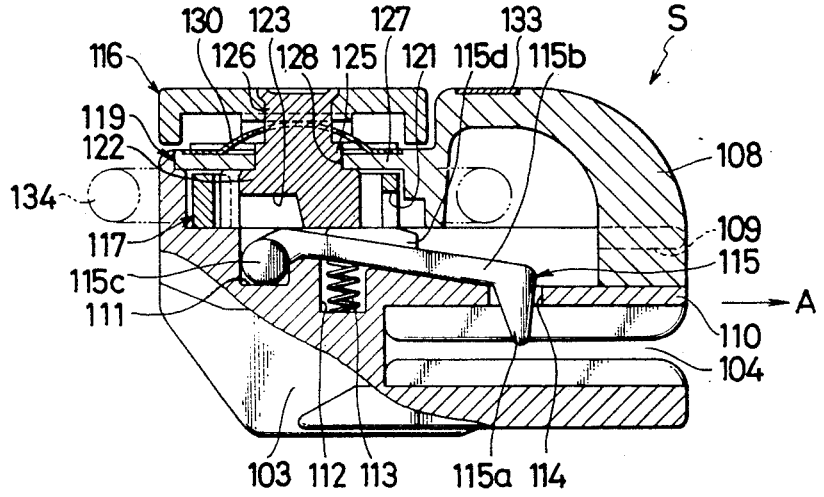
FIG. 6 is a view similar to FIG. 5 but showing the lock assembly in locked position.

The lock assembly 100 comprises a slider body S including upper and lower wings 101, 102 joined at their front ends by a neck 103 so as to define therebetween a guide channel 104 for the passage of two rows of coupling elements E, E of the slide fastener F as shown in FIG. 3. A ring member 105 is mounted forwardly of a top surface of the upper wing 101 and has a cutaway portion 106 directed to the rear end of the upper wing 101 on which an arcuate lug 108 is disposed to pivotally connect a detachable pull tab not shown. The ring 105 has a radially extending rib 107 formed on the upper inner wall for purposes to be described. The lug 108 has one end extending into the opening 106 of the ring 105 and the other outwardly projected ends snugly fitted to two elongate grooves 109 formed edgewise of a plate 110 in the upper wing 101. The plate 110, as shown in FIGS. 5 and 6, is provided at one end with a vertical recess 111 located below the ring 105 and also with a similar recess 112 arranged to receive a coil spring 113 and at the opposite end with an aperture 114 into and out of which a lock prong 115 is mounted to protrude The lock prong 115 is generally in the form of an elongate plate having an arcuate cam **115*c* engageable with the recess 111, a flat portion 115*b* extending therefrom, a projection 115*d* on the portion 115*b* and a downwardly directed pawl 115*a*. The lock prong 115 is normally biased by the spring 113 in unlocked position. Magnetic biasing may if necessary be done for instance by the use of a magnetically treated lock prong combined with a magnetic structure received in place of the spring 113 in the recess 112**.

Figure 7:
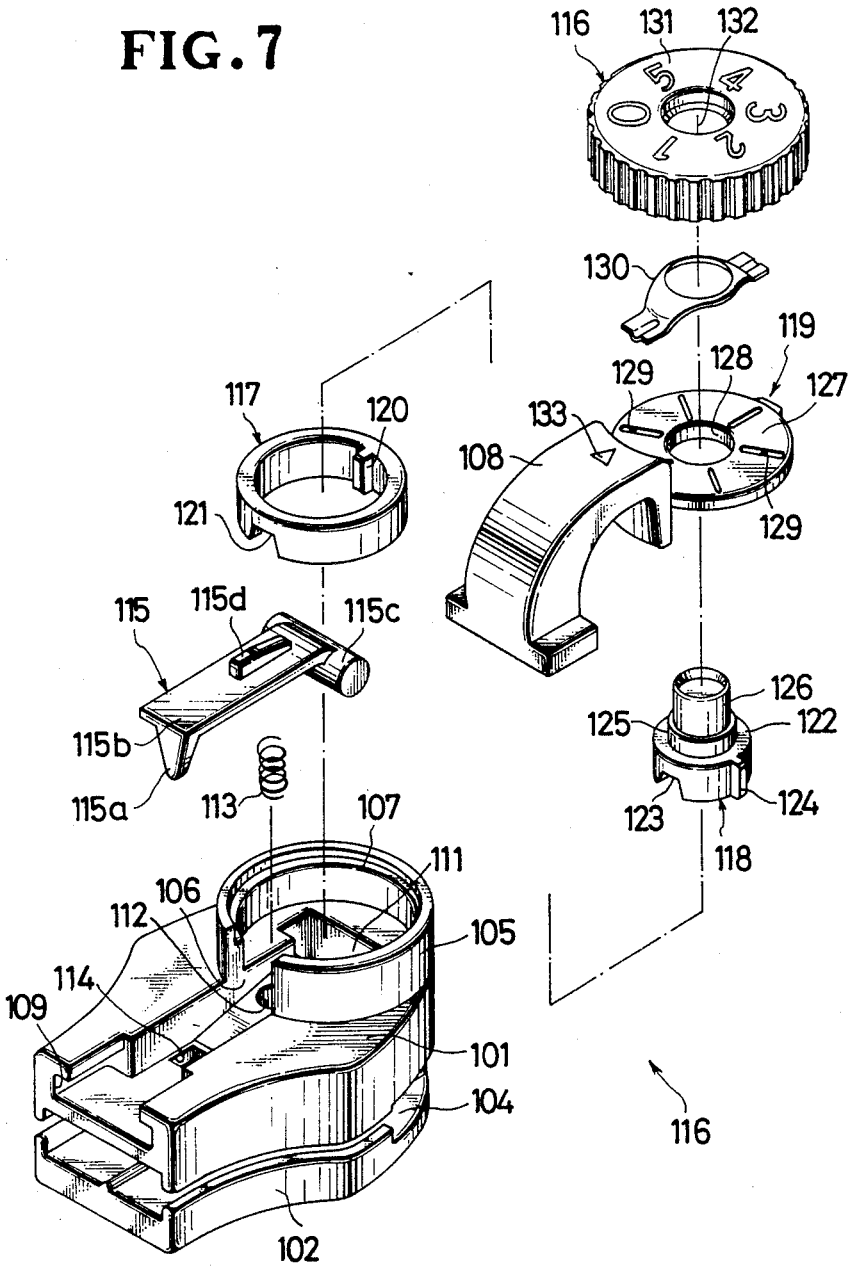
FIG. 7 is an exploded perspective view of the lock assembly shown in FIG. 1.
Figure 8:
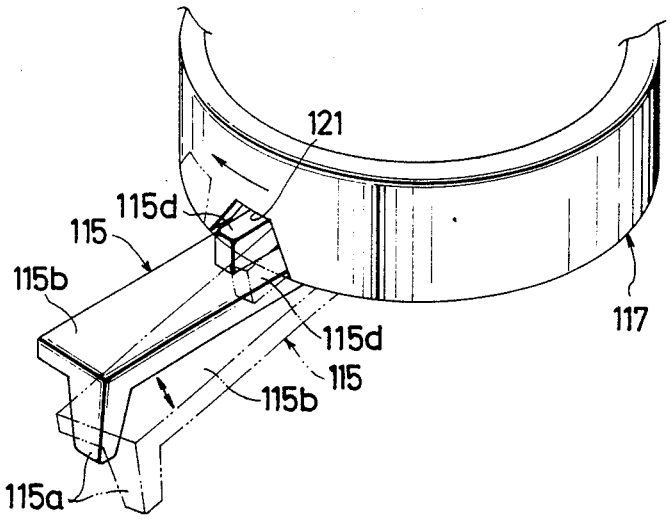
FIG. 8 is a schematic, fragmentary perspective view of a lock prong forming a part of the lock assembly, and shown as cooperative with an annular sleeve.
Figure 9:
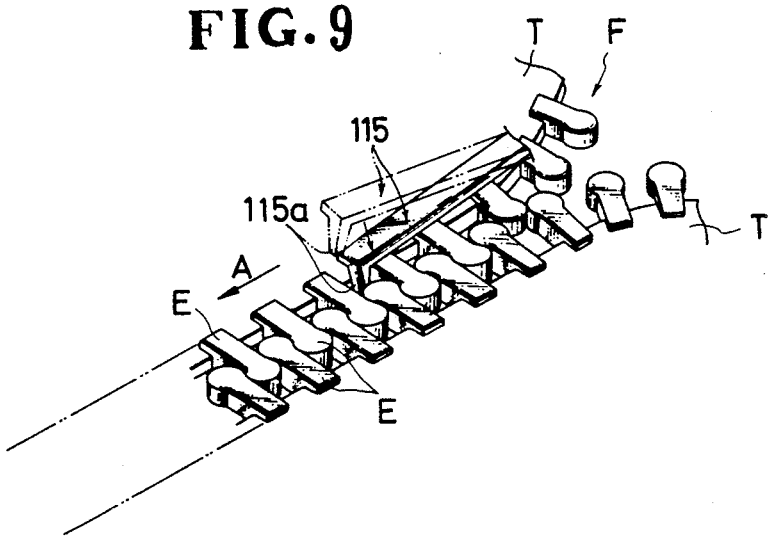
FIG. 9 is a view similar to FIG. 8 but showing the lock prong as engaged with and disengaged from the coupling elements of a slide fastener.

As is better seen from FIG. 7, a dial mechanism 116 comprises an annular sleeve 117, an engaging member 118 and a disc presser 119. The sleeve 117 has a cutout 121 and an inwardly directed protrusion 120. The engaging member 118 is made up of a mount 122, a tip step 126 and an intermediate step 125 interposed therebetween, the mount 122 being provided with a cutout 123 and an outward protrusion 124. The engaging member 118 is rotatable in the sleeve 117, the rotating movement being restrictive on arrest of the protrusion 124 of the member 118 by the protrusion 120 of the sleeve 117. The cutouts 121, 123 act together for entry of the projection 115*d* on the lock prong 115 as the latter prong retracts out of the aperture 114 in the course of unlocking.

The presser 119 includes a disc plate 127 provided centrally with an opening 128 and on the top surface with a plurality of equally spaced radial slots 129. This presser 119 is fixedly secured in a horizontal posture to the front wall of the lug 108 (FIG. 7). The presser 119 is adapted to mount on the engaging member 118 with the disc plate 127 engaged through the opening 128 with the intermediate step 125 of the member 118. After assembling of the lock mechanism 116, the presser 119 is held in interengaged relation to the radial rib 107 in the ring 105.

Mounted on the presser 119 is a leaf sprig 130 registrable with a tip step 126 of the engaging member 118 and corotatable with a dial 131 on the lock mechanism 116. This contributes to good clicking.

The dial 131 carries on its top surface a series of indicia such as numerical figures. The lock mechanism 116 is rotatable about a phantom axis 132.

Designated at 133 is an indicator mark shaped on the lug 108 and at 134 is a link of a pull tab not shown.

The dial mechanism 116 is assembled with the ring 105 by locating the coil spring 113 in the recess 112 and subsequently by registering the pawl 115*a* and the cam 115*c* of the lock prong 115, respectively, with the aperture 114 and the recess 111. Thereafter, the components parts 117, 118, 119, 130 and 131 are superposed in this order.

With the above construction, the lock assembly 100 can be locked and unlocked with reliability. When the dial 131 is turned to set at a given index, both cutouts 121 and 123 of the sleeve 117 and the engaging member 118 are oriented to communicate with each other, as viewed in FIG. 5 which represents the unlocked position of the lock prong 115, thereby allowing entry of the projection 115*d* of the lock prong into the cutouts 121 and 123. In such instance, the lock prong 115 is pushed upwardly under the tension of the spring 113 as shown by the arrow in FIG. 8 so that it moves to retract out of the guide channel 104 and thus returns to its unlocked position.

To lock the lock assembly 100, as the dial 131 is turned toward either direction, the projection 115*d* of the lock prong 115 is brought into frictional contact with the cutouts 121, 123 of the engaging member 118. The lock prong 115 is urged by the spring 113 to thrust at its pawl 115*a* through the aperture 114 into the guide channel 104 for interengagement with either row of coupling elements E. The lock assembly 100 is thus locked in position against movement on the coupling elements E (FIG. 9) even if it is forcibly pulled toward a fastener-opening direction indicated by the arrow A in FIGS. 6 and 9. The lock prong 115 when locked is normally pushed downwardly by the action of the engaging member 118 alone or of both the latter member and the sleeve 117.

Figure 10:
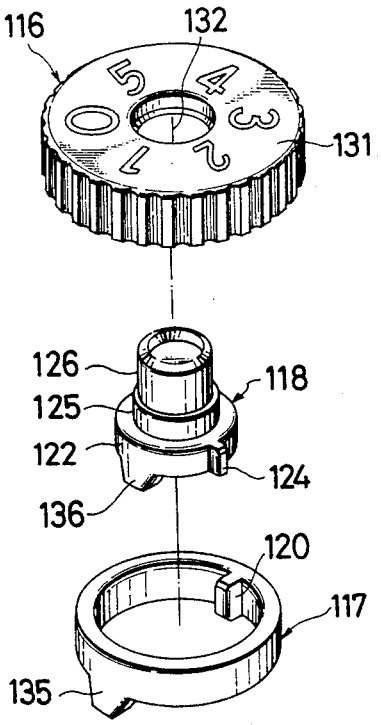
FIG. 10 is an exploded perspective view of a modified form of lock assembly according to the invention.
Figure 11:
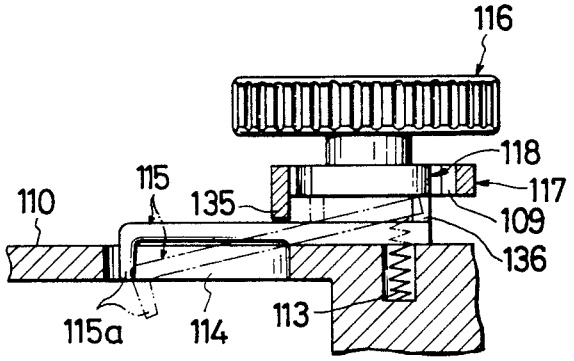
FIG. 11 is a cross-sectional view of the lock assembly of FIG. 10.
Figure 12:
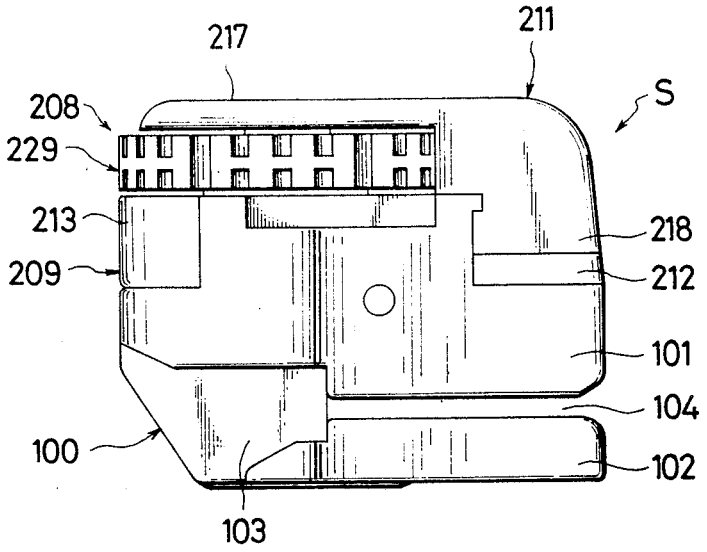
FIGS. 12 through 18 are views similar to FIGS. 1 through 7, respectively, but showing a lock assembly according to a second preferred embodiment of the invention.
Figure 13:
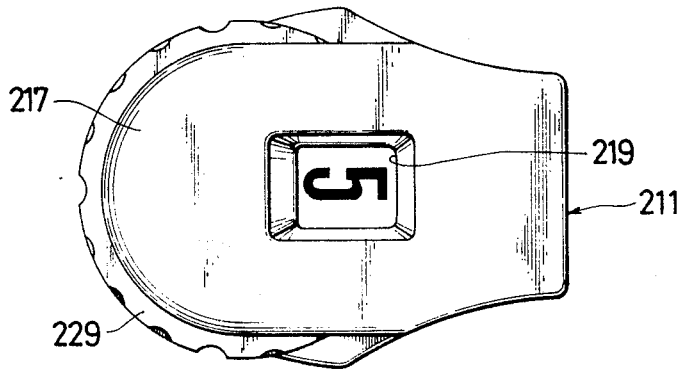
Figure 14:
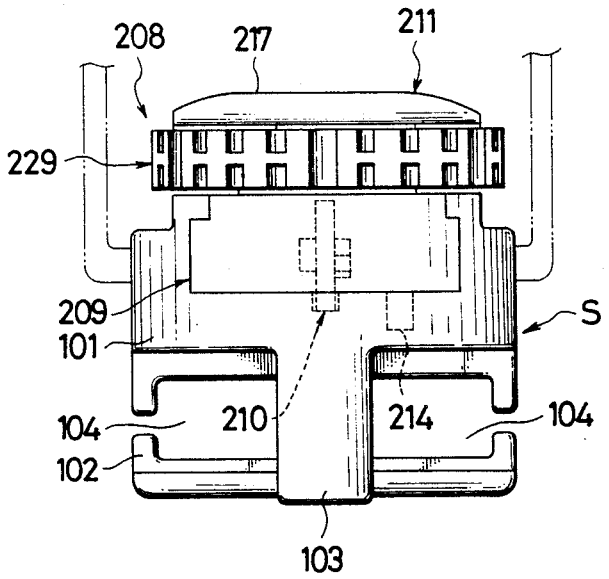
Figure 15:
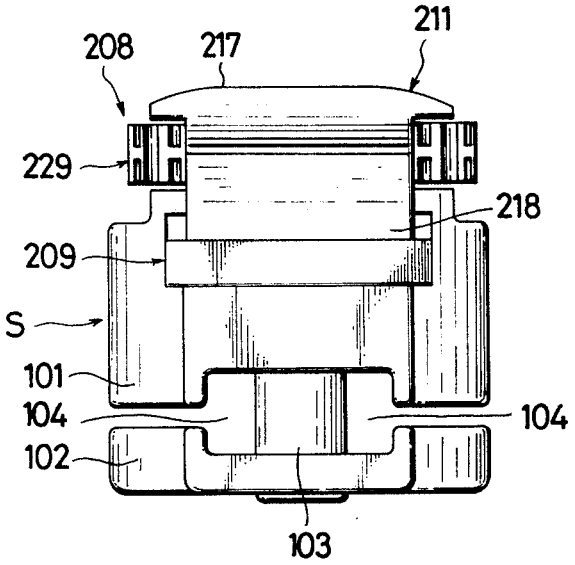

A modified form of the lock assembly 100 shown in FIGS. 10 and 11 is similar in all structural details except for the shape of the sleeve 117 and engaging member 118. A projected portion 135 is formed in place of the cutout 121 in the sleeve 117 and a similar portion 136 in place of the cutout 123 in the mount 122 of the member 118. The lock prong 115 is arranged to hold its pawl 115*a* remained in the aperture 114 under normal bias.

Turning next to FIGS. 12 to 20, there is shown a lock assembly according to a second preferred embodiment of the invention. Like parts are designated by the same reference numerals as in the first embodiment.

A slider body S comprises an upper wing 101 having on its top surface an upper plate 110. A vertical recess 200 is formed at one end of the plate 110 to support a cam end 115*c* of a lock prong 115, and a similar recess 201 is disposed in spaced relation to the recess 200 so as to receive a coil spring 113. An aperture 114 is arranged in alignment with both recesses 200, 201 at the other end of the plate 110. The recesses 200, 201 and the aperture 114 are axially displaced toward either lengthwise direction. The lock prong 115 is mounted to protrude at its pawl 115*a* into and out of the aperture 114. The lock prong of this embodiment is provided above its pawl 115*a* with a lateral extension 115*e* coplanar with a flat portion 115*b* in place of the projection 115*d* as is in the first embodiment.

Figure 19:
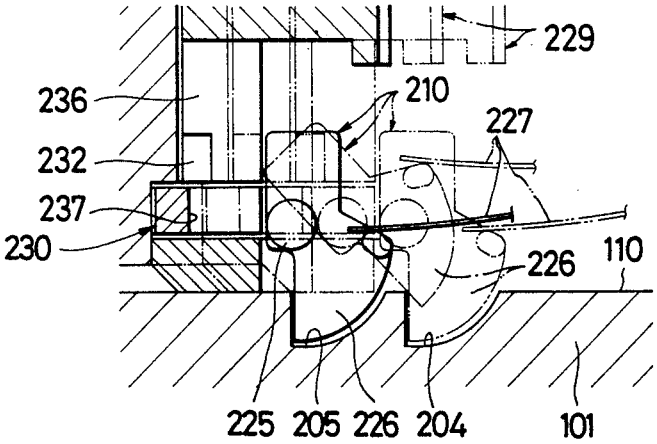
FIG. 19 is a schematic cross-sectional view showing a latch plate as displaced from one latch groove to the other.
Figure 20:
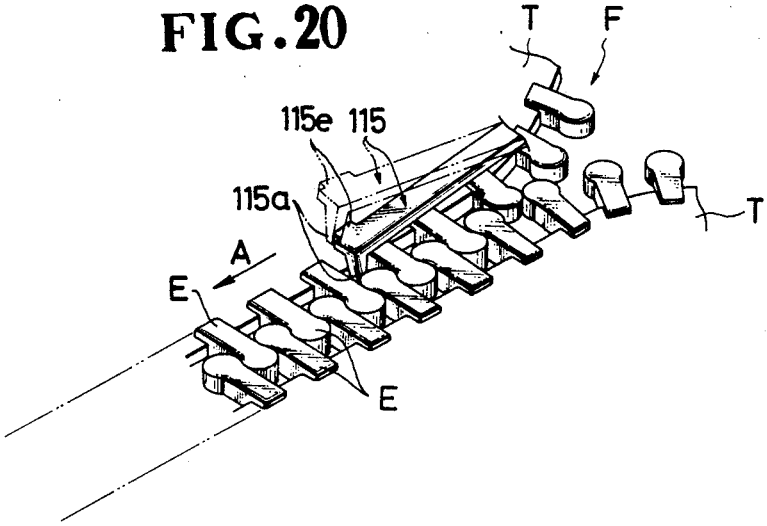
FIG. 20 is a view similar to FIG. 9 but showing a lock prong of the second embodiment.

Designated at 204, 205 are latch grooves positioned centrally of the upper plate 110 and spaced apart at a predetermined distance, as viewed in FIG. 19, for registry with a lock mechanism later described. A pair of upstanding walls 206, 207 are fixed firmly to the upper wing 101 on opposite sides, the walls being adapted to support that lock mechanism.

The lock prong 115 is normally placed in biased condition toward either one of the upward and downward directions. Magnet biasing may be substituted for spring biasing as above noted in connection with the first embodiment.

A lock mechanism 208 is mounted slidably on the plate 110 in supported relation to the walls 206, 207 and comprises a base 209, a cover 211 and a latch plate 210 interposed therebetween.

The base 209 is generally of a plate-like shape having a mount 212 and an engaging portion 213 extending upwardly at one end of the mount 212. Located at the other end of the mount 212 is an axially displaced angular projection 214 frictionally engageable with the extension 115*e* of the lock prong 115. The mount 212 is further provided substantially centrally with a rectangular opening 215 for insertion of the latch plate 210 and at selected positions with a plurality of fixture holes 216 (two in FIG. 18).

The cover 211 comprises a horizontal wall 217 and a slant wall 218 coextensive therewith, the wall 217 having on the top surface a window 219 and on the bottom surface a projection 220 for interfitting with a dial later described. A cylindrical casing 221 is provided in the slant wall 218 to accommodate a ball 222 and a coil spring 223 both for clicking purposes. The cover 211 is adapted to be attached firmly with the base 209 as on a suitable tool by registering the holes 216, 216 of the base 209 with two projections 224, 224 extending downwardly of the walls 217, 218.

A latch plate 210 is constituted by an integral latch axis 225 adapted to be guided into the cover 211, an end portion 226 for engagement into and out of the grooves 204, 205 on the plate 110 and a leaf spring 227. The latch plate is normally biased by the spring 227 in a position to interfit with either one of the latch grooves 204, 205.

Figure 16:
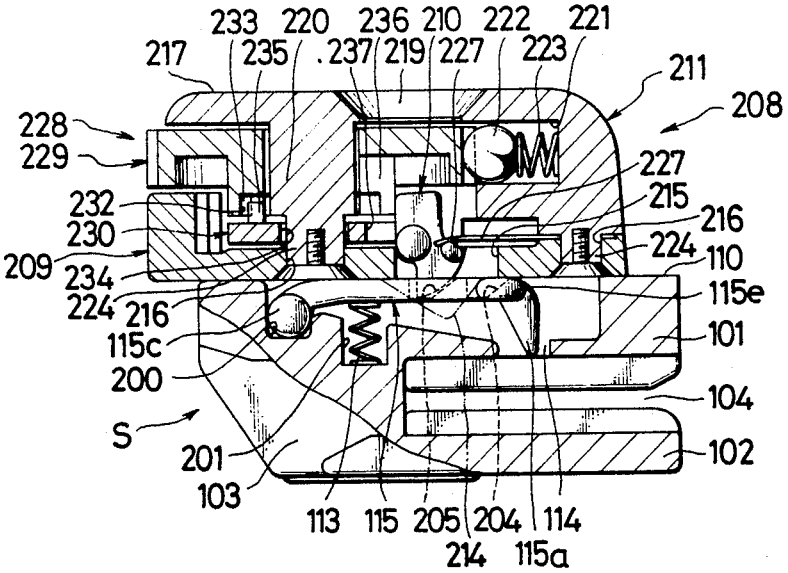
Figure 17:
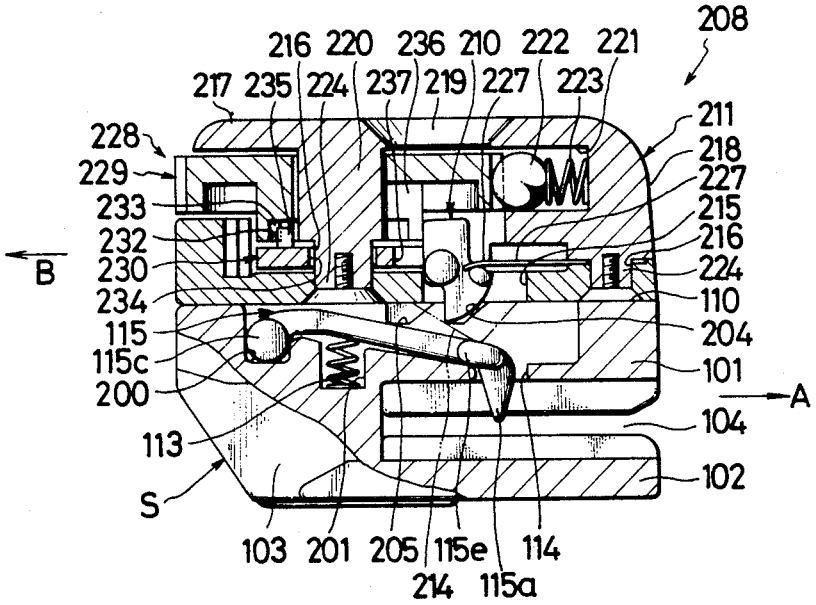
Figure 18:
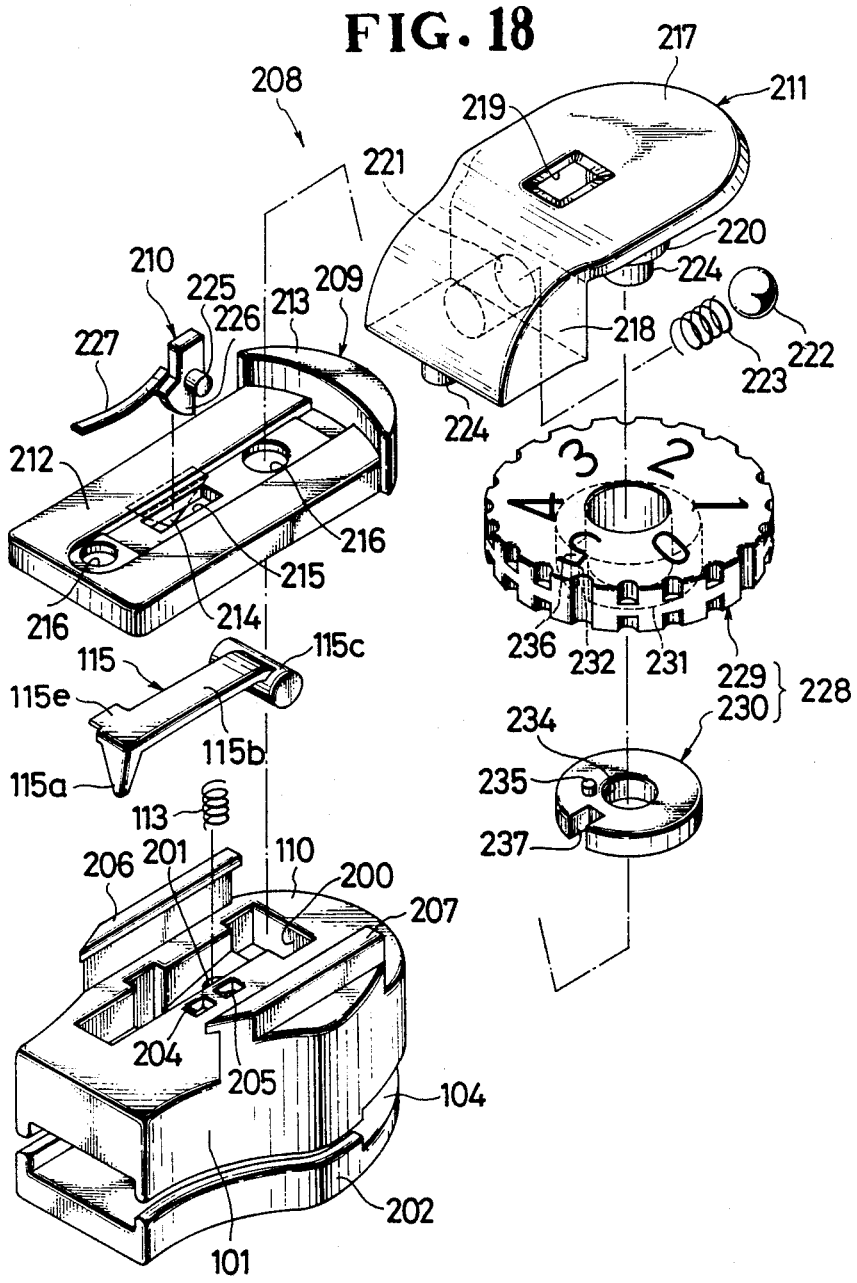

A dial 228 is arranged between the latch plate 210 and the cover 211 to lock the lock mechanism 208 in locked and unlocked positions. The dial 228 is comprised of a dial plate 229 and a disc plate 230. Formed in the dial plate 229 is a circular portion 231 provided at its lower end with an annular groove 232 having a driving protrusion 233 (FIGS. 16 and 17). The dial plate 229 carries on its top surface a set of indicia as in the first embodiment. The disc plate 230 is provided centrally with an opening 234 and on the top surface with a driven projection 235 engageable with the driving protrusion 233 (FIGS. 16 and 17). In the circular portion 231 and also in the disc plate 230, cutouts 236, 237 are provided to allow entry of the latch plate 210.

This arrangement ensures reliable locking operation of the lock assembly on a slide fastener F. When the lock mechanism 208 is placed in locked position as shown in FIG. 17, the projection 214 of the base 209 is pushed to ride on the extension 115*e* of the lock prong 115 so that the pawl 115*a* of the lock prong is allowed under the tension of the spring 113 to protrude through the aperture 114 toward the guide channel 104. The extension 115*e* is in turn thrusted into a gap between the coupling elements E, E as seen from FIG. 20. Even on exposure to intense force tending to pull the lock assembly in a fastener-opening direction (the arrow A in FIGS. 17 and 20), the lock prong 115 can block the lock assembly against movement on the slide fastener with the extension 115*e* held in interengaged relation with the coupling elements E, E.

In the case of the cutouts 236, 237 of the dial plate 229 and disc plate 230 facing with the latch plate 210, the lock mechanism 208 is in unlocked position and the lock prong 115 in locked position. This means that the lock assembly per se is in provisionally locked position. To attain full locking, the dial plate 229 can only be rotated toward either direction.

To unlock the lock prong 115, the dial plate 229 is rotated to set at a given index to thereby register both cutouts 236, 237 for entry of the latch plate 210 and thus unlock the lock mechanism 208. Subsequent sliding movement of the lock mechanism in a direction shown in FIG. 17 causes the projection 214 of the base 209 to become disengaged from the extension 115*e* of the lock prong 115; that is, the lock prong is pushed upwardly against the tension of the spring 113, whereby the pawl 115*a* is moved to retract from the guide channel 104 into the aperture 114. In the course of retraction, the latch plate 210 turns counterclockwise against the leaf spring 227 and hence slides out of one groove 204 into the other groove 205 with a click, after which the lock assembly gets fully unlocked for sliding movement on the row of coupling elements E of the slide fastener F.

To put the lock prong 115 into a locked position, the lock mechanism 208 is moved toward a direction opposed to the arrow B (FIG. 17) until it is matched endwise with the slider body S. In this instance, the latch plate 210 makes an up-and-down motion, displacing from one groove 204 to the other groove 205.

Various changes and modifications may be made in the above specified embodiments as conceived by those skilled in the art within the scope of the appended claims.

What is claimed is:

1. A lock device adapted to be used on slide fasteners for opening and closing the same, which comprises:

(a) a slider body comprising upper and lower wings joined at their front ends by a neck so as to define therebetween a guide channel for the passage of two opposite rows of coupling elements of the slide fastener;

(b) a lock prong disposed on a top plate in said upper wing and movable between a lock position to engage with the coupling elements and an unlocked position to disengage from the same, said lock prong being normally biased toward either one of said locked and unlocked positions;

(c) a dial lock mechanism mounted integrally on a front end of a top surface of said upper wing and adapted to move said lock prong in said locked and unlocked positions, said lock mechanism comprising a ring member, an annular sleeve, an engaging member, a disc presser and a dial superposed in this order; and (d) an arcuate lug extending in opposed relation to said lock mechanism from a rear end of said upper wing and having one end secured to said upper wing and an opposite end connected to said lock mechanism, said lug being adapted to pivotally mount a pull tab.

2. The lock device of claim 1 wherein said ring member has on its upper inner wall a radially extending rib.

3. The lock device of claim 1 wherein said annular sleeve has a cutout and an inward protrusion.

4. The lock device of claim 1 wherein said engaging member is composed of a mount having a cutout and an outward protrusion, an intermediate step and a tip step, said cutout cooperative with a cutout of said annular sleeve for entry of a rear end of said lock prong when the same is placed in unlocked position, said protrusion engageable with a protrusion of said sleeve to thereby limit the rotation of said engaging member in said sleeve.

5. The lock device of claim 1 wherein said disc presser has a disc plate provided centrally with an opening and on the top surface with a plurality of radial slots, said disc plate being fixed to a front wall of said arcuate lug and mounted on the intermediate step of said engaging member, said presser being held in interengaged relation to a radial rib in said ring member.

6. The lock device of claim 1 further including a leaf spring registrable with a tip step of said engaging member and corotatable with the dial.

7. A lock device adapted to be used on slide fasteners for opening and closing the same, which comprises:

(a) a slider body comprising upper and lower wings joined at their front ends by a neck so as to define therebetween a guide channel for the passage of two opposite rows of coupling elements of the slide fastener;

(b) a lock prong disposed on a top plate on said upper wing and movable between a locked position to engage with the coupling elements and an unlocked position to disengage from the same, said lock prong having at its front end a lateral extension and being normally biased toward either one of said locked and unlocked positions;

(c) a vertical recess formed at one end of said top plate on said upper wing for receiving therein a rear end of said lock prong, said recess being axially displaced toward either lengthwise direction;

(d) a pair of latch grooves disposed centrally on said upper wing;

(e) a pair of upstanding walls attached integrally on to said upper wing on opposite sides; and (f) a dial lock mechanism slidably movable on said upper wing in supported relation to said upstanding walls to thereby allow said lock prong to move in said locked and unlocked positions, said lock mechanism comprising a base, a cover, a latch plate interposed therebetween and a dial.

8. The lock device of claim 7 wherein said base being generally in the form of a plate having a mount, an engaging portion extending upwardly at one end thereof, an axially displaced angular projection and a rectangular opening substantially at a central portion thereof, said angular projection engageable with the extension of said lock prong and said rectangular opening receptive of said latch plate.

9. The lock device of claim 7 wherein said cover is provided with a horizontal wall and a slant wall coextensive therewith, said slant wall having disposed therein clicking means.

10. The lock device of claim 7 wherein said latch plate has a latch axis guided in said cover, an end portion registered with said latch grooves and a leaf spring, said latch plate being normally biased in engagement with either one of said latch grooves.

11. The lock device of claim 7 wherein said dial is disposed between said latch plate and said cover and provided with a dial plate and a disc plate, said dial plate having at its inner lower end a cutout and a driving protrusion, said disc plate having on a side wall a cutout and on a top surface a driven protrusion, the first-mentioned cutout cooperative with the last-mentioned cutout for entry of said latch plate, said driving and driven protrusions coengageable during rotation of the dial.

* * * * *

UNITED STATES PATENT AND TRADEMARK OFFICE

CERTIFICATE OF CORRECTION

PATENT NO. : 4,951,485

DATED : August 28, 1990

INVENTOR(S) : Kiyoyasu Wake

It is certified that error appears in the above-identified patent and that said Letters Patent is hereby corrected as shown below:

On the title page, delete the heading "[30] Foreign Application Priority Data", and the two Japanese patents listed therebelow.

Signed and Sealed this

Seventh Day of April, 1992

*Attest:*

HARRY F. MANBECK, JR.

*Attesting Officer*

*Commissioner of Patents and Trademarks*